United States Patent [19]

Zuber

[11] Patent Number: 4,892,134

[45] **Date of Patent: * Jan. 9, 1990**

[54] ELECTROMAGNETIC MOLD FOR CONTINUOUS CASTINGS

[75] Inventor: Laurent Zuber, Chalais, Switzerland

[73] Assignee: Swiss Aluminium Ltd., Chippis, Switzerland

[ * ] Notice: The portion of the term of this patent subsequent to Apr. 23, 2002 has been disclaimed.

[21] Appl. No.: 701,962

[22] Filed: Feb. 14, 1985

[30] Foreign Application Priority Data

Feb. 22, 1984 [CH] Switzerland ..... 848/84

[51] Int. Cl.[4] ..... B22D 27/02

[52] U.S. Cl. ..... 164/503; 164/436

[58] Field of Search ..... 164/503, 467, 436, 491; 60/581, 592, 594; 417/383

[56] References Cited

U.S. PATENT DOCUMENTS

| | | | |
|---|---|---|---|
| 2,009,515 | 7/1935 | Pardee | 60/592 X |
| 2,399,505 | 4/1946 | Phillips | 60/594 X |
| 2,414,675 | 1/1947 | Stelzer | 60/594 |
| 4,093,184 | 6/1978 | Wieschel | 60/592 X |
| 4,512,386 | 4/1985 | Haller | 164/503 X |

FOREIGN PATENT DOCUMENTS

| | | | |
|---|---|---|---|
| 1469166 | 2/1967 | France | 164/436 |

*Primary Examiner*—Kuang Y. Lin

*Attorney, Agent, or Firm*—Bachman & LaPointe

[57] ABSTRACT

An electromagnetic mold for continuous casting comprises side and endwalls each of which features an inductor part with induction loop and a screen. An endwall can be displaced along and secured to the sidewalls by means of releasable bolts while the related inductor parts and the screens are connected to closed loops via a clamping facility with pistons in piston chambers. To improve this means of fixing and for faster fitting into place, the piston chambers are connected via branch lines or channels to a compression chamber in a piston bore and fitted with a compression medium which can be put under pressure by a main piston.

4 Claims, 2 Drawing Sheets

ELECTROMAGNETIC MOLD FOR CONTINUOUS CASTINGS

CROSS REFERENCE TO RELATED APPLICATION

This application is related to co-pending application Ser. No. 441,225, now U.S. Pat. No. 4,512,386, which is assigned to the assignee of the instant application.

BACKGROUND OF THE INVENTION

The present invention relates to an electromagnetic mold for continuous casting having side and endwalls each of which comprises an inductor part with inductor loop and a screen such that at least one endwall can be displaced along and secured to the sidewalls by means of releasable bolts, while the related inductor parts and screens are connected to closed loops via a clamping facility with pistons in piston chambers.

Using such electromagnetic molds for direct chill casting the molten metal is poured at a given rate onto a dummy block situated within a loop-shaped electrical inductor. High frequency alternating current in the inductor generates an electromagnetic field which constrains the molten metal horizontally within the inductor in a shape which is essentially determined by the inner contours of the inductor loop. By jetting with coolant, for example water, the metal at and close to the surface solidifies rapidly as the strand is lowered.

Such equipment usually features an electromagnetic screen which is tapered downwards. This is mounted coaxially within the inductor and is made of metal (for example stainless steel). The shape of this screen has the effect of diminishing the strength of the magnetic field above the inductor so that the electromagnetic forces limiting the cross-section of the head of the ingot are smaller. A more detailed description of the advantages of such a screen is presented in U.S. Pat. No. 3,605,865.

As do rectangular ingots cast by conventional continuous casting the ingots cast continuously with the above mentioned electromagnetic molds usually exhibit slightly concave sidewalls. The reasons for this disturbing effect are described in detail in the German patent publication No. DE-OS-28 48 808.

Electromagnetic molds for continuous casting are complicated and expensive, especially because of the small dimensional tolerances which have to be observed when making the molds. Also, a large number of ingot formats is normally required, which means that a corresponding number of molds has to be kept in store. It will be readily appreciated that this is economically unattractive.

Known from the German patent No. DE-AS 10 59 626 is a continuous casting mold with displaceable endwalls. The function and construction of a conventional continuous casting mold are, however, basically different from those of an electromagnetic mold; the special knowledge of one cannot therefore be transferred to the other. The conventional mold serves to conduct away the heat of the melt by direct contact with the melt. It also serves as the container for the melt and must therefore be sealed around its whole periphery.

The electromagnetic mold, however, does not come into contact with the melt. It serves to supply the electric current in a specific manner and contains facilities for influencing the magnetic field further.

For this reason special locking elements were developed for electromagnetic molds to permit variable positioning and fixing of the endwalls on the sidewalls—which makes it possible to vary the size of the mold opening and thus ingot cross-section. A special clamping device on the endwalls connects the relevant inductor parts to the screen so that there are always closed loops with the mold. This clamping device features a camshaft which, when rotated causes pistons to bring special contact elements into contact with each other. This clamping device, however, suffers the disadvantage that it has to be specially actuated for each of the contacts to be made between the end and sidewalls, and such that for uniform setting one requires exactly coordinated, synchronous movements. Furthermore the pressure applied to the contact elements depends solely on the rotation of the camshaft which, if made such that its motion is very easy, introduces the risk of the contact pressure being reduced while the mold is in service. Also the contact elements can be withdrawn from the clamping device only to the same extent as the height of the cam.

Accordingly, it is the principal object of the present invention to develop a clamping device for making the connection between the endwall and sidewalls, which does not exhibit the above noted disadvantages and, in particular, can be brought into use very quickly. Furthermore, the possible range for displacement of the compression piston and its pressure should be variable.

SUMMARY OF THE INVENTION

The foregoing object is achieved by way of the present invention wherein piston chambers are connected, via branch lines or channels, to a compression chamber in a piston bore and are fitted with a compression medium which can be put under pressure by a main piston.

If a pressure is applied to the main piston, this ensures that the pistons in the piston chambers move uniformly and are subjected to a uniform pressure.

The main piston should preferably be fitted, on the side away from the compression chamber, with bellows fitted at one end with a plate against which rests a disc that is penetrated off-center by an axle shaft. If this disc is moved in a particular direction by means of a lever, as a result of the off-center positioning of the shaft, the disc presses on the plate which in turn presses on the bellows and thus also on the main piston. The bellows sever basically as a buffer to cushion excessively high pressure in the compression chamber and/or to even out for example vibrations within the mold. This way the whole clamping facility can as desired be brought into contact with the inductor parts and screen by means of a single move of the hand. The same applies to releasing the clamping facility.

Beyond the main piston the compression chamber in the piston base is delimited by a regulating piston, the position of which can be altered by a setting screw. This enables the pressure of the pistons on the contact elements to be increased and/or larger spacing between the clamping facility and the sidewalls to be accommodated.

All the pistons are effectively sealed against the walls of their piston chambers by means of ring-shaped seals.

This clamping facility is extremely simple in design and therefore very resistant to break down. Any desired pressure medium can be provided in the compression chamber and channels or branch lines, preferably a hydraulic fluid.

BRIEF DESCRIPTION OF THE DRAWINGS

Further advantages, features and details of the invention are revealed in the following description of a preferred exemplified embodiment and with the aid of the drawings wherein.

DETAILED DESCRIPTION

Figure 1:
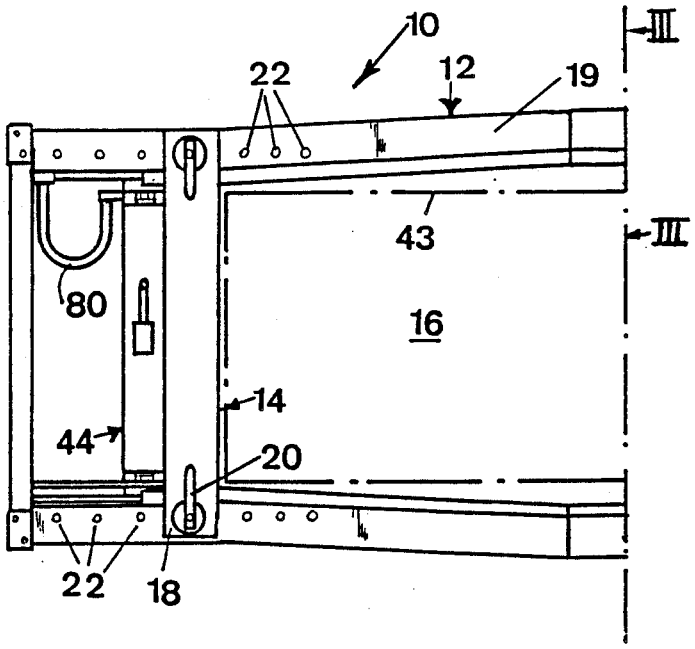
FIG. 1 is a plan view of one half of an adjustable electromagnetic mold.
Figure 2:
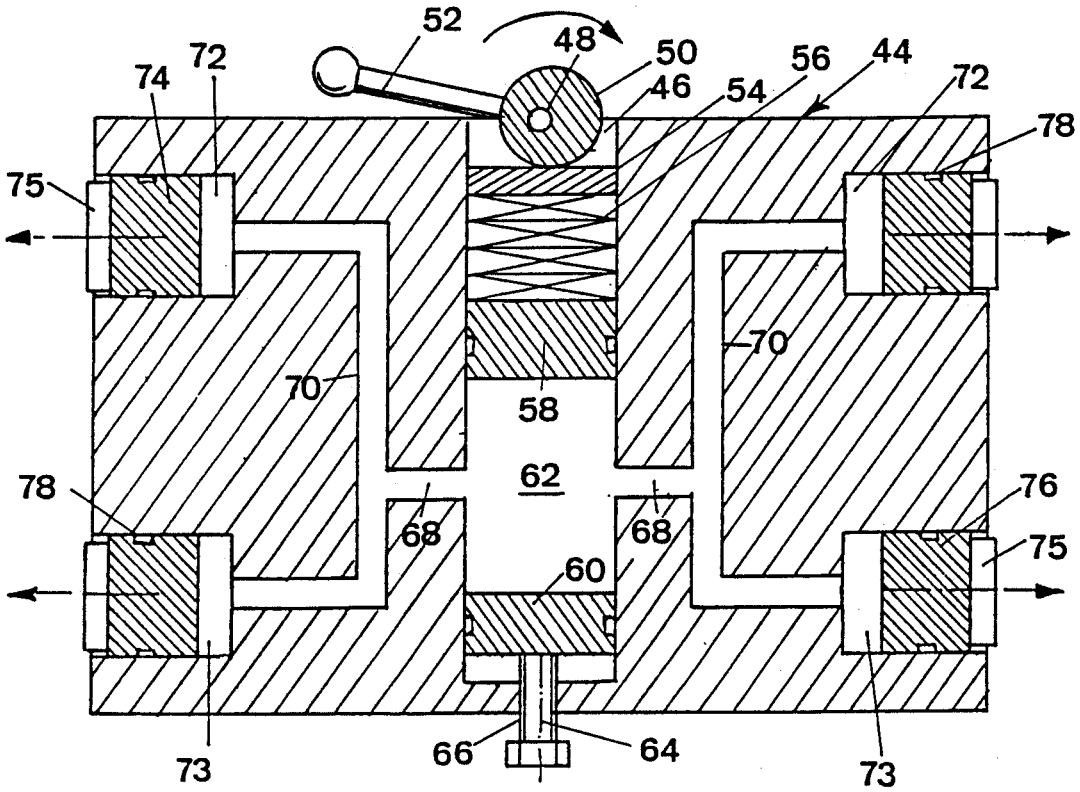
FIG. 2 is an enlarged longitudinal section through a clamping device.
Figure 3:
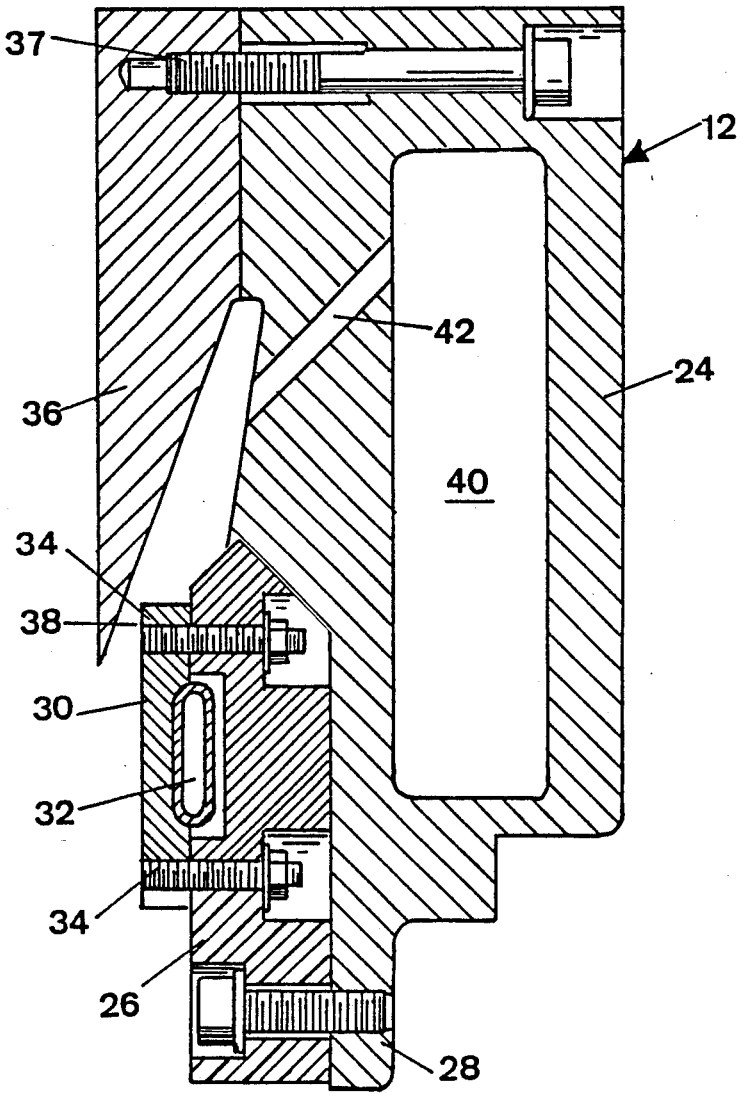
FIG. 3 is the mold sidewall sectioned along line III—III in FIG. 1.

The mold 10 shown in FIGS. 1 to 3 features a pair of facing sidewalls 12 and a pair of moveable endwalls 14 which together form the mold space 16. The endwalls 14 can slide on surface 19 of sidewalls 12 via shoes 18. A spring braced bolt 20 is mounted on shoe 18 at sidewall 14 and fits into blind holes 22 arranged at preselected distance apart in surface 19 of sidewall 12. The sidewalls 14 can thus be secured at the desired points along sidewalls 12.

As FIG. 3 shows a sidewall 12 of mold 10 features a mold frame 24 to which an insulating component 26 is secured by bolt 28. Mounted on to this and held in place by bolts 34 is an induction loop 30 which is cooled by a cooling channel 32. Mounted on to the mold frame 24 by further bolts 37 is an electromagnetic screen 36 which is set such that there is a gap 38 between it and the induction loop; a jet of cooling water coming from chamber 40 via channel 42 impinges on the surface of ingot 43 which is indicated only by a broken line in FIG. 1. The endwalls 14 are constructed similar to the sidewalls 12.

Provided on the back of sidewall 14 is a clamping facility 44 to connect electrically the induction loop 30 of sidewall 12 to an induction loop on sidewall 14 which is not shown here, and also to connect electrically the screen 36 on sidewall 12 to a screen on the endwall.

This clamping facility 44, as shown in FIG. 2, features a cylindrical piston bore 46 which is bridged by an ale shaft 48 that passes off-centre through a disc 50 such that the disc 50 can be moved round the shaft 48 in direction x by a lever 52. In doing so the excentric disc 50 presses on a plate 54 in the piston bore 46 and, via bellows 56, places a main piston 58 under pressure. Between this piston 58 and a regulating piston 60 is a compression chamber 62 to accommodate compressed air or hydraulic fluid. Via regulating piston 60 that size of the compression chamber 62 and thus the pressure in it can be changed. This is performed by means of an adjustment screw 64 which features thread 66 and passes through the clamping facility 44 and piston bore 46 from below and presses on piston 60 on the side away from the compression chamber 62.

Leading out of both sides of compression chamber 62 are channels 68 each of which is connected to two cylindrical spaces 72 and 73 via branch lines 70. Situated in spaces 72 and 73 are pistons 74 and 76 resp. with end plates 75. When in the operating position the upper pistons 74 engage with the screen 36 of sidewall 12, while the lower pistons 76 provide the connection to the induction loop 30. Contact elements which are not shown here can be employed to compensate for differences between side and endwall 12, 14.

All the pistons 58, 60, 74, 76 are fitted with ring-shaped seals 78. Pipes 80 supply the coolant to cooling channels 32 of induction loop 30.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A mold for use in the electromagnetic casting of molten metal comprising a pair of side walls and a pair of end walls, each of said side walls and said end walls being provided with an inductor portion and a screen portion, means provided on one of said side walls and said end walls for selectively positioning and securing said one of said side walls and said end walls at different positions on the other of said side walls and said end walls for adjusting the size of the mold cavity and means for providing electrical contact between the inductor portions of said side walls and said end walls and the screen portions of said side walls and said end walls so as to form an inductor characterized by a closed loop and a screen characterized by a closed loop, said means for providing electrical contact comprises a fluid link having a compression cylinder in fluid communication with a plurality of motor cylinders, said plurality of motor cylinders each being provided with a motor piston having one end in biasing contact with one of said inductor and said screen and the other end in contact with the fluid in said fluid link and a compression piston means reciprocally mounted in said compression cylinder for compressing said fluid so as to bias said motor pistons against one of said inductor and said screen.

2. A mold according to claim 1 wherein said compression piston means comprises a piston having one end in contact with said fluid and the other end in contact with one end of a bellows wherein the other end of the bellows is in contact with a plate and motor means associated with said plate for reciprocating said plate.

3. A mold according to claim 1 wherein said compression cylinder is provided with means for adjusting the volume of said cylinder.

4. A mold according to claim 1 wherein said pistons are provided with seals on the peripheral surfaces thereof.

* * * * *